United States Patent [19]

Peritz et al.

[11] 4,125,302

[45] Nov. 14, 1978

[54] EASY-LEVELING SUPPORT DEVICE

[76] Inventors: Leigh A. Peritz, 63 Washington St., Winchester, Mass. 01890; Alan C. Huber, 9 Philemon St., Arlington, Mass. 02174

[21] Appl. No.: 683,004

[22] Filed: May 4, 1976

[51] Int. Cl.[2] ..... A47B 5/00

[52] U.S. Cl. ..... 312/242; 312/245; 108/149; 248/328

[58] Field of Search ..... 312/242, 245; 211/113, 211/117; 108/149; 248/328, 323, 317, 318, 320, 329; 182/142, 150

[56] References Cited

U.S. PATENT DOCUMENTS

| | | | |
|---|---|---|---|
| 515,559 | 2/1894 | Sonntag et al. | 108/149 |
| 2,051,241 | 8/1936 | Biggers | 108/149 |
| 2,091,868 | 8/1937 | Mattson | 108/149 |
| 2,306,266 | 12/1946 | Heim | 108/149 |
| 2,468,412 | 4/1949 | Schaefer | 108/149 |
| 2,533,416 | 12/1950 | Anthes | 108/149 |
| 3,465,893 | 9/1969 | Kinney | 108/149 |
| 3,901,165 | 8/1975 | Schlesinger | 108/149 |

FOREIGN PATENT DOCUMENTS

| | | | |
|---|---|---|---|
| 493,288 | 5/1950 | Belgium | 108/149 |
| 943,790 | 3/1949 | France | 108/149 |
| 376,575 | 6/1923 | Fed. Rep. of Germany | 108/149 |
| 159,456 | 7/1957 | Sweden | 108/149 |

*Primary Examiner*—Victor N. Sakran
*Attorney, Agent, or Firm*—Robert A. Cesari; John F. McKenna; Andrew F. Kehoe

[57] ABSTRACT

A novel, easy-to-level, wall-supported support member which is particularly useful for support of apparatus requiring a horizontal surface on which to operate properly. Particular advantageous use of the apparatus is as a support for a phonograph turntable. The apparatus is suitable for compact packaging, is easy to mount and easy to assemble from a kit.

1 Claim, 7 Drawing Figures

A
B

EASY-LEVELING SUPPORT DEVICE

BACKGROUND OF THE INVENTION

This invention relates to a novel, easily-levelled, wall-mounted, horizontal, support table for use with phonograph turntables and the like.

Many apparatus, particularly phonograph turntables and the like, require a level surface on which to operate properly. Usually such apparatus are mounted on shelving that is wider than standard shelving, or mounted on relatively expensive furniture. Levelling screws are usually necessary to compensate for minor deviations from the horizontal. In either situation, the cost of the support surface is relatively high; the positioning of the support surface is limited in view of the existing arrangement of furniture of shelving within the room; and there is a substantial chance that undesirable vibration will be transmitted to or from the turntable.

Thus, there has remained a need for a simple, easily-levelled, dedicated-use-type apparatus which can be used to support apparatus requiring a level surface. In approaching the invention to be described below, applicants were particularly interested in providing apparatus which can be conveniently attached to a wall.

SUMMARY OF THE INVENTION

Therefor, it is a principle object of the invention to provide a wall-hung support member which is easily levelled and particularly suited to provide substantially horizontal support for phonographic turntables and other devices requiring a level surface.

Another object of the invention is to provide a support apparatus which avoids substantial undesirable vibration.

A further object of the invention is to provide a support apparatus comprising a quick-locking, level-adjusting means.

Still another object of the invention is to provide an adjustable support apparatus as described above to hold various-sized objects in a snug, low-vibration position.

Another object of the invention is to provide a novel quick-locking clamp member.

Further objects of the invention are to provide those novel processes, for using and constructing the apparatus described.

It is a further object of the invention to provide an apparatus, as described in the above-listed objects, which is conveniently and advantageously shipped and merchandized in a compact kit arrangement.

Other objects of the invention will be obvious to those skilled in the art on reading the following disclosure.

Applicants have substantially achieved the above objects by constructing an article-support apparatus comprising a support member for providing a horizontal surface and a support means which is a flexible cord, advantageously a single continuous cord, slideably attached to said support in such a way as to allow the cord and support member to be moved in relationship one to the other so that, when the cord is slideably supported from a wall, the support apparatus can be tilted around an axis parallel to the wall and an axis normal to the wall.

Advantageously, clamp means are used which allow the cord to slide through the clamps when they are in a release position. The clamp means are then closed when the support member is in the required horizontal position.

The support member is best supported from four points which, roughly, form a rectangle. In one favored embodiment, a rectangular support base is formed of two pairs of parallel supports, one pair comprising members which are adjustably mounted, with and respect to each other, on the other pair, to provide means to hold articles of various widths in snug, vibration-free relationship.

As will be seen in the embodiment to be described below, at least one segment of a singular cord is advantageously strung across the apparatus parallel to the wall support. It is advantageous that this segment of cord be positioned in a channel within the support member.

The apparatus of the invention is best used in conjunction with two-position clamps through which the cord may slide when the clamps are in released position. It is advantageous that the clamps be attractive. The preferred clamps provide (1) a cord-receiving means attachable to the wall and through which the cords may slide when the clamp is in a released position and (2) a cylindrical sleeve which fits over the descending segments of the cord and can be slid up over the cord receiving means and the cord to lock them into a non-sliding relationship. The sleeve's elongate cylindrical shape also tends to direct the cord outwardly from the wall at an angle which, in some cases, reduces the potential for undesirably high frictional engagement between the cord and the support member.

The suspending cord can be metallic, e.g. a steel wire or chain. However, it is much preferred that the cord have a small, say 1 to 5%, elongation under about 10 lbs. of tension. This characteristic of the cord is believed to be valuable in absorbing or otherwise minimizing undesirable vibration which could be transmitted through a more rigid material. Moreover, it is preferred that the cord have other than a smooth cylindrical surface. Thus, a braided cord, more particularly a braided cord of synthetic resin material such as nylon is preferred. This feature seems to minimize any resistance between the support structure members and cord during the adjusting step. Of course, smooth surfaces are operable and, indeed, when treated with lubricants, or when carried through rollers, or when provided with self-lubricating material (e.g. a polyetrafluorethylene surface) such cords are wholly satisfactory though somewhat less economical.

Among other devices requring substantially horizontal supports of the type described are centrifugal equipment, many kinds of clocks, apparatus like hot plates on which cooking utensils must be supported to provide flat cooking surface and the like. Depending upon the nature of the item to be supported, the supporting member can be a single flat table member, four member, four members forming a rectangular frame or even a triangular frame.

Illustrative Example of the Invention

In this application and accompanying drawings, there is shown and described a preferred embodiment of the invention and suggest various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

In the Drawings

Figures 1, 2, 3, 4, 5, 6:
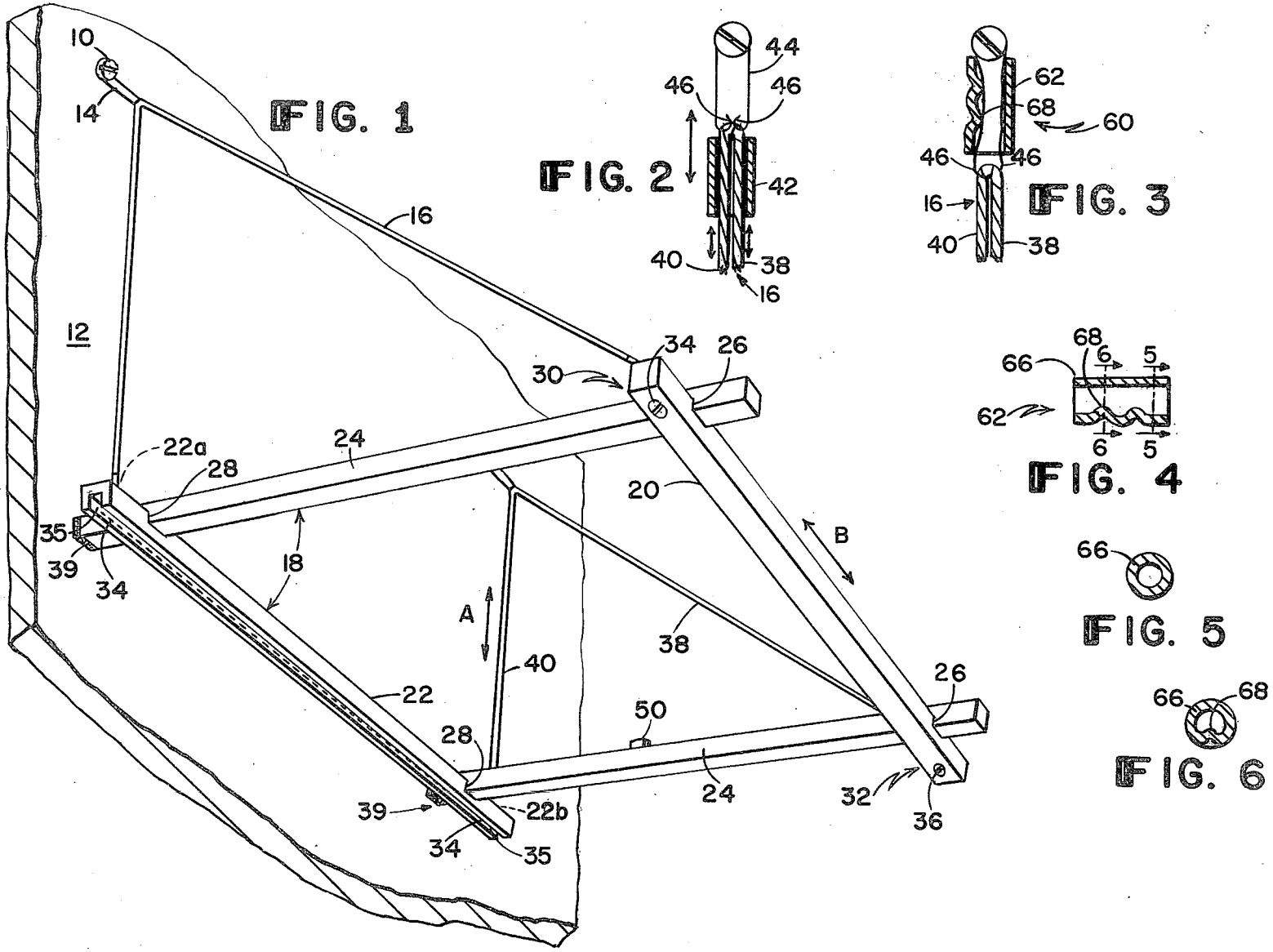
FIG. 1 is a perspective view of an apparatus constructed according to the invention, said view being taken from below and to the left of the apparatus as it is supported from the wall.
FIG. 2 is exploded drawing illustrating the particular clamp utilized with the apparatus of FIG. 1.
FIG. 3 illustrates another clamp configuration.
FIGS. 4, 5 and 6 illustrate sections through and at each end of the tubular slide member of the clamp of FIG. 3.

Referring to FIG. 1, it is seen that two fasteners, screws 10 (one of which is hidden behind the structure) are attached to a supporting wall 12. Attached to screw 10 are clamps 14 which hold a nylon cord 16 of about 0.125-inch diameter. On cord 16 is suspended a support structure 18 formed of front crossbar 20, back crossbar 22, and two lateral arms 24 which are notched at 26 and 28 to fit over bars 20 and 22, respectively, and hold them in spaced relationship from one another. Arms 24 are removeably, but snugly, fit into bars 20 and 22 as the user desires. Cord 16 is unitary and is attached to the support structure 18 at positions 30 and 32 proximate the front corners thereof.

Conveniently, the ends of the cord can be knotted and thereby anchored in apertures 34 and 36. Tracing the cord from aperture 34, it is seen that it proceeds upwardly to a clamp 14; then downwardly to rearmost crossbar 22; then through an aperture 22*a* (not visible on the drawing, but readily apparent as to its position to any skilled in the art) along a channel 35 cut into crossbar 22, acting as a guide means, for this segment of the cord which is adapted for being parallel to the wall and horizontal to gravity, and upward by through another aperture 22*b*, proximate the opposite end of crossbar 22 from aperture 22*a*, to second clamp 14; and then downwardly along cord segment 38 aperture 36 to a position wherein it is again knotted.

Clamps 14 can be of many designs as will be understood by those skilled in the fastening and buckling arts. However, the clamp shown in FIG. 2 is of a particularly advantageous type because it is quick-releasable, easily fastened, and provides relatively little friction to the cord being pulled through the clamp during adjustment of the plane.

As illustrated in FIG. 2, clamps 14 comprise a locking cylinder 42, and a cord-support spring 44 which is a wire in the shape of an inverted U which is hooked around screw 10. Wire 44 terminates at each end in an open hook 46. Hooks 46 receive incoming cord segments such as vertical 40 and diagonal segment 38 of cord 16, allowing the cord to slip freely between them when locking cylinder 42 is in its released or lower position as seen in FIG. 2. When cylinder 42 is raised to engage spring 44, it clamps the cord snugly within the clamp structure.

It will be obvious in view of this discussion of the function of clamp 14 that many other clamping devices can be utilized which form means to hold the cord when arranged in one relationship thereto but will allow the cord to slip therethrough when moved to a second position. However, the specifically-disclosed clamp is particularly advantageous in view of its attributes of 1. quick releaseability,
2. allowing manipulation of cord position without actually touching the clamp while it is in the released position, because the cylinder will be conveniently retained near the ultimate clamping position.
3. dependability and snugness of the clamp in its cord immobilizing position, and
4. the relative attractiveness of the clamp. Moreover, the illustrated clamp is selected from constructions which provide that the downwardly extending segments (such as segment 40) of the cord are directed outwardly from the wall and do not rub against the wall at any point. This feature of the clamp also promotes a more vertical entrance of the cords into aperture such as 22*a* and consequently assures minimal drag, or frictional resistance, of cord on crossbar 22.

Note also that vibration-dampening means such as rubber pads 39 are advantageously fastened to member 24 to minimize wall-to-table vibration.

The support device of the invention is conveniently assembled in the following manner.

1. Screws 10 are placed in the wall but not tightened (Note that a somewhat uneven placement is of little consequence - the apparatus of the invention is capable of compensating for such an error.)
2. Wire 44 of clamps 14 are hooked under screws 10 and the screws are tightened.
3. A loose assembly is made of arms 24 and bars 22 and 20. Cord 16 is fed through the members 24, 22 and 20 as described above, with two long loops, approximately equal in size, left at the top for attachment to clamps 14.
4. Cylinder 44 is slid over segments 40 and 38, until a loop of cord appears at the top. This loop is fed through the lower hooks 46 of wire 44. This leaves the apparatus hanging in a non-adjusted position on wall 15.
5. When a device like a phonograph turntable is placed on the support apparatus (as seen in FIG. 1) the cord will slip in response to hand pressure exerted thereon by the user. It is recommended that a level be used to adjust the device. Indeed, when the apparatus is sold in kit form, it is desirable to include a small 360°-type, circular, bubble-type level (as shown at 50) in the kit.
6. When the equipment is levelled, cylinders 46 are slid up over wire 44 and the cord is locked in a level position.

The particular advantage of the apparatus is assignable to the fact that the single cord allows levelling of the desired support plane along the axes which are (1) parallel to the wall and normal to gravity and (2) perpendicular to the wall and normal to gravity. This is achieved by the fact the cord is positioned for elongation along length A (as seen in FIG. 1) on the apparatus being pulled along vector B.

It should be noted that the angle between the segment 38 and segment 40 will, preferably, be more than about 30° and most advantageously 45°. This reduces any drag in those embodiments of the invention wherein the cord is in direct contact with a wood finish.

It is to be noted that the apparatus illustrated is particularly valuable wherein member 24 can be moved to fit snugly against downwardly extending legs of a phonograph turntables of various sizes. It is to be understood that many applications will allow the supporting member formed of arms 24, 22 and 20 to be replaced by a plank or other supported member.

A variation in the clamp construction is one illustrated in FIGS. 3–6 wherein a tube-shaped portion 62 of a clamp 60 is moved upwardly to a release position and downwardly to a clamp position. In such a situation, tube member can be somewhat shorter, and some of a wire loop 63 will be visible when the clamp is in closed position. Moreover, as seen in FIGS. 4 through 6, there is an indentation 64 in tube 62 which causes a protrusion 66, preferably along the side of the tube adjacent to the wall, to rise from the front face 68 of the inside of the tube, a cross sectional view of which is shown in FIG. 5 to a substantial ridge at the back of the tube as seen in FIG. 6. Intermediate along the protrusion 66 are bumps 68 which serve to give the user a "snap-like" feel and confirmation when the slider tube 62 is pulled down snugly over the cord.

Figure 7:
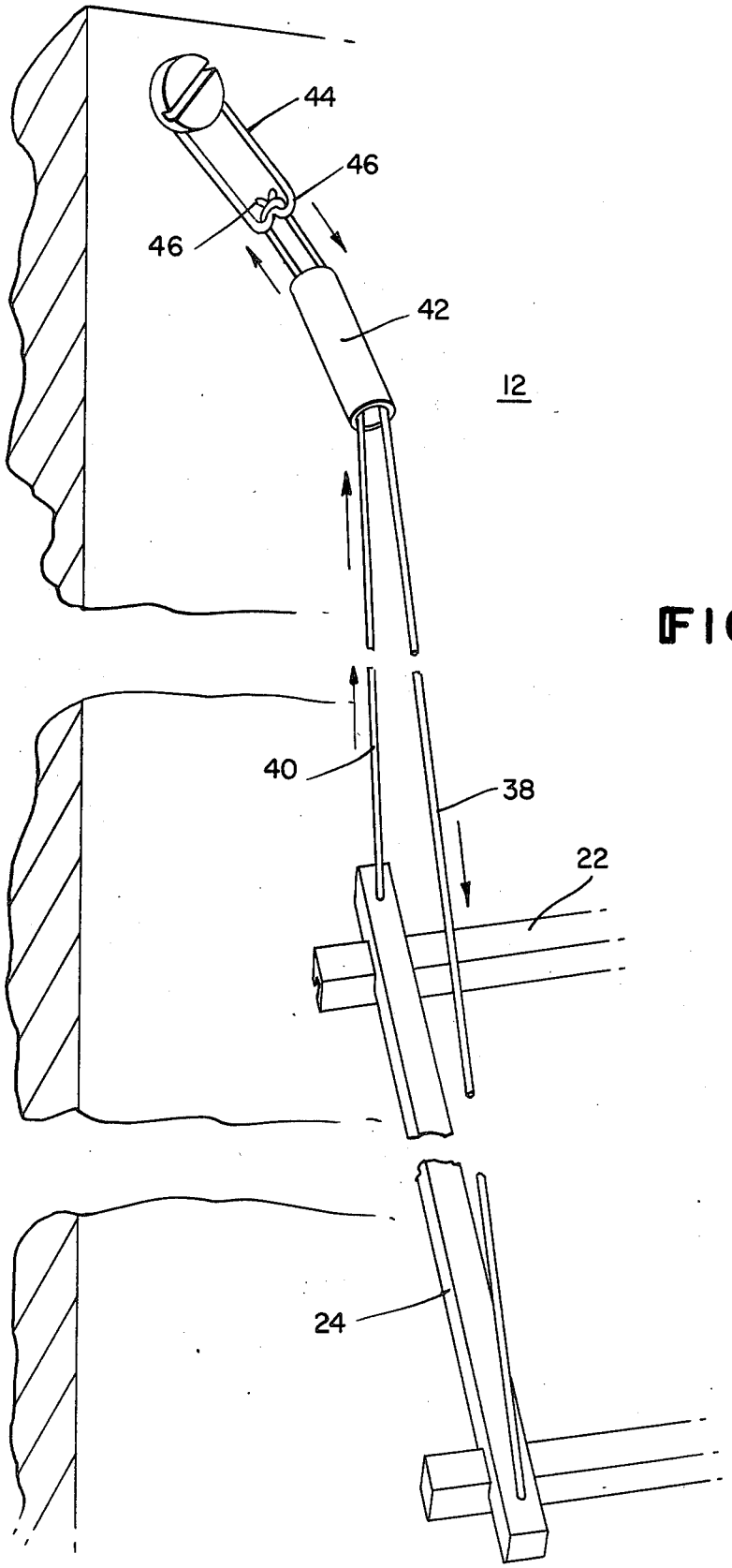
FIG. 7 is a fragmentary view of the apparatus in perspective indicating the movement of the support surface to a plane proximate to, and parallel to, the wall.

Another advantageous feature of the apparatus of the invention is that it can very easily be converted, without removal from the wall, into a structure in which the support surface hangs in a plane proximate to, and parallel to, the wall 12 as seen in FIG. 7. Thus, if the cord is allowed to slide through hooks 46, when locking cylinder 42 is in its released or lower position so that the rearmost segments, such as segment 40, become very short and the forward segments such as segment 38 become very long, the rearmost segments and forward segments will become essentially parallel with member 20 and 22 each being adjacent the wall and, roughly, lying in a plain parallel to the wall. This feature of the invention makes use of the fact that the connection between the cord and member 22 and 24 allows easy pivoting of member 22 and the entire support surface in a plane normal to a wall support.

It should also be noted that while the apparatus of the invention is utilized primarily to supply a support surface for apparatus which is itself level, it is to be recognized that the invention also allows the careful selection of a non-level surface to compensate for any irregularities in apparatus to be supported thereon and make easy the level support of such apparatus.

It is to be understood that the following claims are to cover all of the generic and specific features of the invention herein described and all statements of the scope of the invention which might be said to fall therebetween.

What is claimed is:

1. An article-support apparatus adapted for hanging from a wall and comprising a. a support member forming means to provide a horizontal support plane;

b. attachment means including a flexible cord to attach said support member to said wall;

c. said attachment means comprising also (1) a cord-receiving membr adapted to be fixed to said wall and forming means to allow the cord to slide therethrough and (2) a locking member to lock said cord into non-sliding relationship with said cord-receiving member;

c. said cord slideably arranged with respect to said attachment means and said cord-receiving member to form means to tilt it around an axis normal to a wall from which said apparatus is hung, and move said support means to a horizontal position and wherein said cord follows a path from a. a first front side position of said support plane, b. on a diagonal segment backwardly and upwardly toward said wall and through one said attachment means, c. on a vertical segment, downwardly to one side at a back position of said first side of said support plane, d. across and under said support plane to a back position of a second side of said support plane, e. on a diagonal segment, upwardly through another said clamp means and f. on a diagonal segment downwardly and forwardly to a front position on said second side of said support plane, and wherein said cord means, when in said released position, forms means to allow the elongation of said diagonally segments and a shortening of said vertical segments of said cord, thereby forming means to move said support member against said wall.

* * * * *

UNITED STATES PATENT AND TRADEMARK OFFICE

CERTIFICATE OF CORRECTION

PATENT NO. : 4,125,302

DATED : November 14, 1978

INVENTOR(S) : Leigh A. Peritz et al

It is certified that error appears in the above-identified patent and that said Letters Patent are hereby corrected as shown below:

Column 4, line 37: Change "44" to --42--

Signed and Sealed this

*Seventeenth* Day of *July 1979*

[SEAL]

*Attest:*

*Attesting Officer*

LUTRELLE F. PARKER

*Acting Commissioner of Patents and Trademarks*